US008395334B2

(12) United States Patent
Eom et al.

(10) Patent No.: US 8,395,334 B2
(45) Date of Patent: Mar. 12, 2013

(54) REFRIGERATOR

(75) Inventors: Yong Hwan Eom, Seoul (KR); Myung Keun Yoo, Seoul (KR); Hyoun Jeong Shin, Seoul (KR); Ok Sun Yu, Seoul (KR); Young Jin Kim, Seoul (KR); Seung Do Han, Seoul (KR)

(73) Assignee: LG Electronics Inc., Seoul (KR)

( * ) Notice: Subject to any disclaimer, the term of this patent is extended or adjusted under 35 U.S.C. 154(b) by 493 days.

(21) Appl. No.: 12/724,648

(22) Filed: Mar. 16, 2010

(65) Prior Publication Data

US 2010/0236280 A1 Sep. 23, 2010

(30) Foreign Application Priority Data

Mar. 20, 2009 (KR) ..... 10-2009-0024207

(51) Int. Cl.
*H02P 7/00* (2006.01)

(52) U.S. Cl. ..... 318/286; 318/265; 318/466; 318/468

(58) Field of Classification Search ..... 318/264, 318/265, 266, 282, 283, 286, 466, 467, 468, 318/646; 312/116, 319.5, 319.8, 330.1
See application file for complete search history.

(56) References Cited

U.S. PATENT DOCUMENTS

| | | | | |
|---|---|---|---|---|
| 2,873,159 | A * | 2/1959 | Becker | 312/319.7 |
| 4,829,429 | A | 5/1989 | Komai et al. | |
| 5,280,227 | A | 1/1994 | Bashark | |
| 5,392,951 | A | 2/1995 | Gardner et al. | |
| 5,445,294 | A | 8/1995 | Gardner et al. | |
| 5,775,786 | A | 7/1998 | Liebertz | |
| 5,899,083 | A | 5/1999 | Peterson et al. | |
| 5,940,306 | A | 8/1999 | Gardner et al. | |
| 6,130,621 | A | 10/2000 | Weiss | |
| 6,445,152 | B1 | 9/2002 | Calamatas | |
| 6,751,909 | B2 | 6/2004 | Ranaudo | |
| 6,779,855 | B2 | 8/2004 | Hoffman | |
| 7,006,876 | B2 | 2/2006 | Ross | |
| 7,063,398 | B2 | 6/2006 | Hoffman | |
| 7,075,446 | B2 | 7/2006 | Schondelmaier et al. | |
| 7,197,888 | B2 | 4/2007 | LeClear et al. | |
| 7,282,884 | B2 | 10/2007 | Huber et al. | |
| 7,307,395 | B2 | 12/2007 | Bouamra et al. | |
| 7,407,210 | B2 | 8/2008 | Arbaugh et al. | |

(Continued)

FOREIGN PATENT DOCUMENTS

| | | | |
|---|---|---|---|
| CN | 2406551 | A | 11/2000 |
| CN | 1468569 | A | 1/2004 |

(Continued)

OTHER PUBLICATIONS

International Search Report issued in PCT Application No. PCT/KR2008/001694 dated Dec. 3, 2008.
International Search Report issued in PCT Application No. PCT/KR2008/001696 dated Dec. 3, 2008.

(Continued)

*Primary Examiner* — Walter Benson
*Assistant Examiner* — Thai Dinh
(74) *Attorney, Agent, or Firm* — KED & Associates, LLP

(57) ABSTRACT

A refrigerator includes a drawer having a door and a receiving box attached thereto. The drawer may be automatically moved in forward and backward directions. A supply of standby voltage may be intercepted by a drawer driving mechanism when the door is closed so as to reduce power consumption and improve response time to drawer opening and closing commands.

9 Claims, 5 Drawing Sheets

U.S. PATENT DOCUMENTS

| | | | | |
|---|---|---|---|---|
| 7,430,937 | B2 | 10/2008 | Rotter et al. | |
| 7,484,817 | B2 | 2/2009 | Hoffman et al. | |
| 7,533,947 | B2 | 5/2009 | Kim et al. | |
| 7,587,907 | B2 | 9/2009 | Kim et al. | |
| 7,594,707 | B2 | 9/2009 | Kunkle et al. | |
| 7,602,135 | B2 | 10/2009 | Huber et al. | |
| 7,633,258 | B2 | 12/2009 | Huber et al. | |
| 7,641,707 | B2 | 1/2010 | Kang et al. | |
| 7,688,015 | B2 | 3/2010 | Wenzel et al. | |
| 7,731,314 | B2 | 6/2010 | Kim | |
| 7,784,888 | B2 | 8/2010 | Oh et al. | |
| 7,800,477 | B1 | 9/2010 | Komer | |
| 7,802,515 | B2 | 9/2010 | Suetsugu | |
| 7,812,561 | B2 | 10/2010 | Hagen et al. | |
| 7,859,203 | B2 | 12/2010 | Miyashita | |
| 7,868,578 | B2 * | 1/2011 | Scheffknecht et al. | 318/626 |
| 7,928,684 | B2 * | 4/2011 | Hauer | 318/646 |
| 8,067,915 | B2 * | 11/2011 | Hooker et al. | 318/466 |
| 8,074,468 | B2 | 12/2011 | Yoo et al. | |
| 8,134,313 | B2 * | 3/2012 | Zipp | 318/282 |
| 8,141,968 | B2 | 3/2012 | Velarde et al. | |
| 8,169,175 | B2 | 5/2012 | Yu et al. | |
| 8,169,176 | B2 * | 5/2012 | Yu et al. | 318/466 |
| 8,217,613 | B2 | 7/2012 | Yoo et al. | |
| 8,282,177 | B1 | 10/2012 | Rotter | |
| 2001/0009360 | A1 | 7/2001 | Jin | |
| 2002/0171335 | A1 | 11/2002 | Held | |
| 2003/0078710 | A1 | 4/2003 | Li | |
| 2004/0035129 | A1 | 2/2004 | Kaiser | |
| 2004/0100165 | A1 | 5/2004 | Hoffman | |
| 2004/0100166 | A1 | 5/2004 | Hoffman | |
| 2004/0100169 | A1 | 5/2004 | Huber et al. | |
| 2004/0138843 | A1 | 7/2004 | Bouamra et al. | |
| 2005/0128660 | A1 | 6/2005 | Dlugosz | |
| 2005/0284113 | A1 | 12/2005 | Jang et al. | |
| 2006/0061245 | A1 | 3/2006 | Huber et al. | |
| 2006/0087207 | A1 | 4/2006 | Oh et al. | |
| 2006/0087208 | A1 | 4/2006 | Oh et al. | |
| 2006/0096304 | A1 | 5/2006 | Kim et al. | |
| 2006/0104756 | A1 | 5/2006 | Kim et al. | |
| 2006/0196198 | A1 | 9/2006 | Kim et al. | |
| 2006/0207283 | A1 | 9/2006 | Kim et al. | |
| 2006/0226749 | A1 | 10/2006 | Kim | |
| 2006/0242988 | A1 | 11/2006 | Kim et al. | |
| 2006/0261775 | A1 | 11/2006 | Huber et al. | |
| 2006/0267461 | A1 | 11/2006 | Hoffman | |
| 2007/0013274 | A1 | 1/2007 | Hoffman | |
| 2007/0170828 | A1 | 7/2007 | Hoshide et al. | |
| 2007/0256036 | A1 | 11/2007 | Johnson et al. | |
| 2008/0018215 | A1 | 1/2008 | Carden et al. | |
| 2008/0110092 | A1 | 5/2008 | Takahashi | |
| 2008/0116777 | A1 | 5/2008 | Kappler et al. | |
| 2008/0163639 | A1 | 7/2008 | Hwang | |
| 2008/0302114 | A1 | 12/2008 | Kelly et al. | |
| 2008/0314067 | A1 | 12/2008 | Lee | |
| 2009/0026906 | A1 | 1/2009 | Kim | |
| 2009/0091223 | A1 | 4/2009 | Hagen et al. | |
| 2009/0102338 | A1 | 4/2009 | Wenzel et al. | |
| 2009/0160297 | A1 | 6/2009 | Anikhindi et al. | |
| 2009/0199484 | A1 | 8/2009 | Zipp | |
| 2009/0206715 | A1 | 8/2009 | Scheffknecht et al. | |
| 2009/0243454 | A1 | 10/2009 | Yoo et al. | |
| 2009/0248205 | A1 | 10/2009 | Yu et al. | |
| 2009/0248207 | A1 | 10/2009 | Yoo et al. | |
| 2009/0254221 | A1 | 10/2009 | Kang | |
| 2009/0261698 | A1 | 10/2009 | Cabal Velarde et al. | |

FOREIGN PATENT DOCUMENTS

| | | |
|---|---|---|
| CN | 101358792 A | 2/2009 |
| EP | 0779484 | 6/1997 |
| JP | 02-103388 | 4/1990 |
| JP | 02-106686 | 4/1990 |
| JP | 02-136686 | 5/1990 |
| JP | 02-146487 | 6/1990 |
| JP | 03-045820 | 2/1991 |
| JP | 07-174459 | 7/1995 |
| JP | 11-094455 | 4/1999 |
| JP | 2005-326044 | 11/2005 |
| JP | 2006-023039 | 1/2006 |
| JP | 2006-046741 | 2/2006 |
| JP | 2006-046748 | 2/2006 |
| JP | 2006-145055 | 6/2006 |
| JP | 2006-250485 | 9/2006 |
| JP | 2007-017018 | 1/2007 |
| JP | 2007-093208 | 4/2007 |
| JP | 2007-132605 | 5/2007 |
| JP | 2008-8550 | 1/2008 |
| JP | 2008-196744 | 8/2008 |
| JP | 2008-196752 | 8/2008 |
| JP | 2009-036433 | 2/2009 |
| KR | 1999-003684 | 1/1999 |
| KR | 20-0301747 | 1/2003 |
| KR | 20-0334077 | 11/2003 |
| KR | 10-2006-0025806 | 3/2006 |
| KR | 10-0634366 | 10/2006 |
| KR | 10-2007-0080466 | 1/2008 |
| WO | WO 2006/126584 | 11/2006 |
| WO | WO 2007/009783 | 1/2007 |

OTHER PUBLICATIONS

International Search Report issued in PCT Application No. PCT/KR2008/001697 dated Dec. 3, 2008.
International Search Report issued in PCT Application No. PCT/KR2008/001695 dated Dec. 8, 2008.
International Search Report issued in PCT Application No. PCT/KR2010/001497 dated Oct. 22, 2010.
International Search Report issued in PCT Application No. PCT/KR2010/001496 dated Oct. 22, 2010.
International Search Report issued in PCT Application No. PCT/KR2010/001495 dated Oct. 25, 2010.
International Search Report issued in PCT Application No. PCT/KR2010/001409 dated Oct. 25, 2010.
International Search Report issued in PCT Application No. PCT/KR2010/001410 dated Oct. 25, 2010.
U.S. Office Action issued in U.S. Appl. No. 12/390,523 dated Feb. 7, 2012.
U.S. Office Action issued in U.S. Appl. No. 12/390,527 dated Feb. 14, 2012.
U.S. Office Action issued in U.S. Appl. No. 12/724,558 dated Mar. 14, 2012.
U.S. Office Action issued in U.S. Appl. No. 12/390,520 dated Apr. 22, 2011.
Notice of Allowance issued in U.S. Appl. No. 12/390,523 dated Jun. 27, 2012.
Final Office Action issued in U.S. Appl. No. 12/724,558 dated Aug. 13, 2012.
Office Action issued in U.S. Appl. No. 12/724,606 dated Sep. 13, 2012.
U.S. Office Action issued in U.S. Appl. No. 12/390,524 dated Aug. 25, 2011.
U.S. Office Action issued in U.S. Appl. No. 12/345,946 dated Sep. 26, 2011.
U.S. Office Action issued in U.S. Appl. No. 12/345,984 dated Sep. 26, 2011.
Chinese Office Action issued in CN Application No. 2011092100646340 dated Sep. 26, 2011.
U.S. Office Action issued in U.S. Appl. No. 12/510,372 dated Nov. 30, 2011.
U.S. Office Action issued in U.S. Appl. No. 12/345,946 dated May 19, 2011.
U.S. Office Action issued in U.S. Appl. No. 12/345,984 dated May 23, 2011.
Chinese Office Action issued in CN Application No. 201080012399.5 dated Oct. 24, 2012.
U.S. Office Action issued in U.S. Appl. No. 12/724,571 dated Nov. 16, 2012.
U.S. Office Action issued in U.S. Appl. No. 12/726,643 dated Dec. 5, 2012.
U.S. Office Action issued in U.S. Appl. No. 12/724,606 dated Jan. 11, 2013.

* cited by examiner

REFRIGERATOR

CROSS REFERENCES RELATED APPLICATIONS

The present application claims priority under 35 U.S.C. 119 and 35 U.S.C. 365 to Korean Patent Application No. 10-2009-0024207(filed in Korea on Mar. 20, 2009), the entirety of which is incorporated herein by reference in its entirety.

BACKGROUND

1. Field

This relates to a refrigerator.

2. Background

Generally, a refrigerator stores items in a refrigerated or frozen state. Refrigerators may be classified as a top mount type refrigerator, a bottom freezer type refrigerator or a side by side type refrigerator depending on the locations of a freezing chamber and a refrigerating chamber.

BRIEF DESCRIPTION OF THE DRAWINGS

The embodiments will be described in detail with reference to the following drawings in which like reference numerals refer to like elements wherein.

DETAILED DESCRIPTION

In a bottom freezer type refrigerator, a freezing chamber is positioned below a refrigerating chamber, a refrigerating chamber door is rotatably mounted at an edge of one side of a refrigerator main body to open and close the refrigerating chamber, and a freezing chamber door to open and close the freezing chamber may be provided in such a way that it is drawn into and out of the freezing chamber together with a receiving box. Because the freezing chamber is below the refrigerating chamber, when the user opens the freezing chamber, the user must bend at the waist to pull the door of the freezing chamber forward, requiring more effort than when pulling such a door while standing straight.

An automatic opening mechanism may move the freezing chamber door a predetermined distance from a front surface of the main body by sensing the user's movements when grasping and pulling the door handle to open the freezing chamber door. Alternatively, a motor may be fixed to a bottom surface of the freezing chamber, and the freezing chamber door may be drawn in and out by a driving force of the motor.

Figure 1:
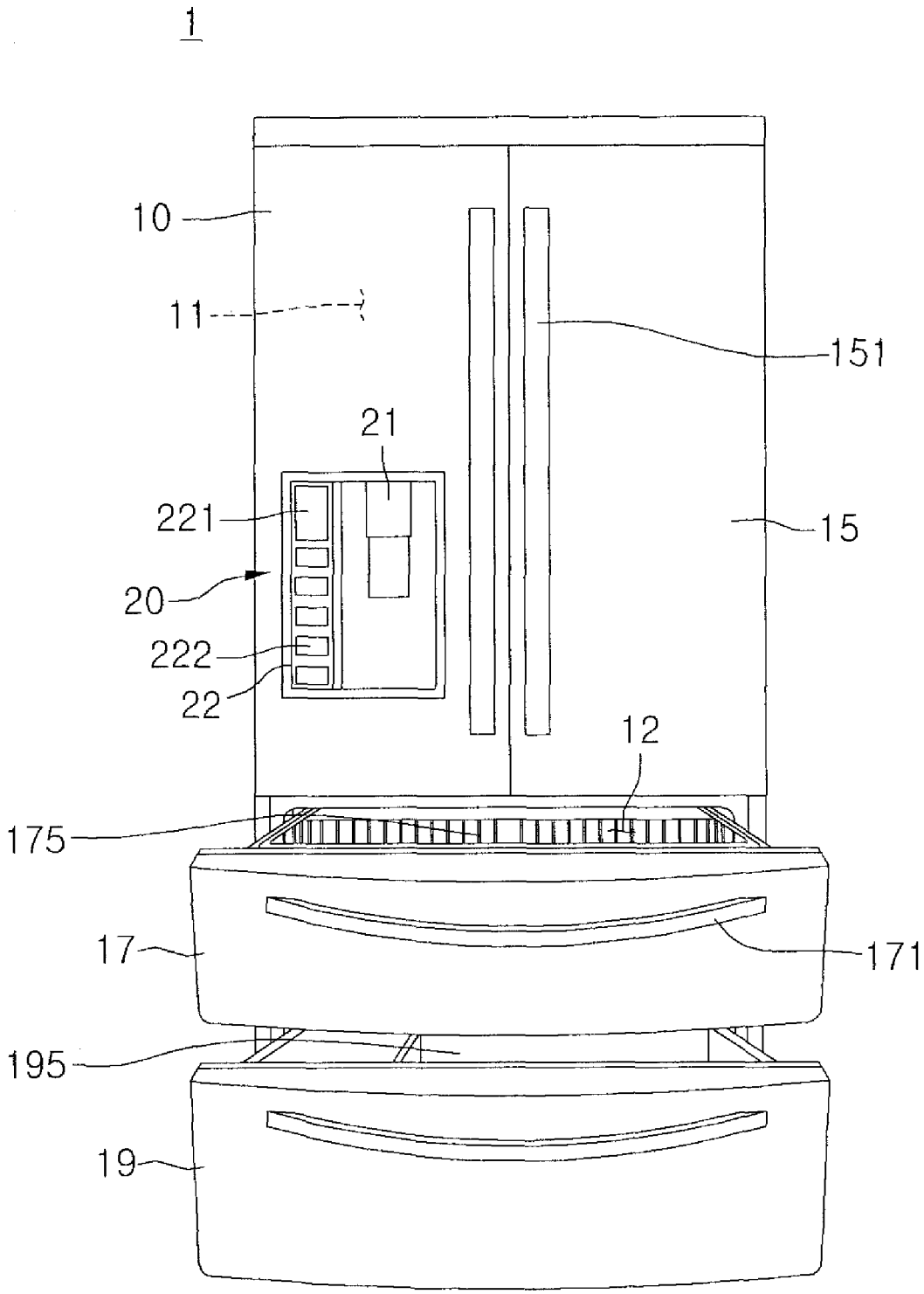
FIG. 1 is a front perspective view of a refrigerator according to an embodiment as broadly described herein.

FIG. 1 is a front perspective view of a refrigerator according to an embodiment as broadly described herein. As shown in FIG. 1, the refrigerator 1 may include a main body 10, and a storage space formed in the main body 10. The storage space may include at least one of a refrigerating chamber 11 to keep items at a low temperature and a freezing chamber 12 to keep items in a frozen state. In this exemplary embodiment, the refrigerating chamber 11 is located at an upper portion of the main body 10, and the freezing chamber 12 is located at a lower portion of the main body 10. Other arrangements may also be appropriate.

The refrigerating chamber 11 may be selectively opened and closed by one or more refrigerating chamber doors 15 that may be rotatably connected to a front surface of the main body 10, and a handle 151 may be provided on a front surface the refrigerating chamber door 15.

The freezing chamber 12 may be selectively opened and closed by one or more freezing chamber doors 17, 19. The freezing chamber 12 may be divided into one space or two or more spaces, depending on user preferences, and the spaces may be separately used. In this exemplary embodiment, the freezing chamber 12 is divided into two spaces. Thus, in this exemplary embodiment, the freezing chamber doors 17, 19 include an upper door 17 covering an upper space and a lower door 19 covering a lower space of the freezing chamber 12.

The upper door 17 may be slidably drawn in and out, thereby opening and closing the upper space of the freezing chamber 12. Further, a receiving box 175 may be detachably coupled to a rear side of the upper door 17 so that the upper door 17 and the receiving box 175 are drawn out or in together. Hereinafter, the doors 17, 19, and the receiving boxes 175, 195 mounted at each door will be referred to as a "drawer."

A handle 171 may be provided at a front surface of the upper door 17. The upper door 17 may be slidably drawn out and in by pulling and pushing the handle 171 after manually grasping the handle 171. Alternatively, the door 17 may be automatically slidably drawn out and in response to a user command received at an input device.

Like the upper door 17, the lower door 19 may be slidably movable, selectively opening and closing a lower space of the freezing chamber 12 and, the receiving box 195 may be detachably coupled to a rear side of the lower door 19.

A dispenser 20 may be provided at one of the refrigerating chamber doors 15, or other location as appropriate. The dispenser 20 may include a discharging portion 21 for discharging water or ice water and an operation portion 22 provided at one side of the discharging portion 21. The operation portion 22 may include a display 221 for displaying an operation state of the dispenser 20 or the refrigerator 1, and a plurality of buttons for inputting commands related to functions provided by the refrigerator 1.

The operation portion 22 may include input means 222 for inputting drawing out and in commands to slide one of the doors 17, 19, or other commands as appropriate. Input means 222 may be provided as a single button through which both drawing in commands and drawing out commands may be input, or a drawing out button and a drawing in button may be separately provided.

A machine room may be provided, separate from the storage space, to house elements for generating cold air, such as a compressor, a condenser, an expansion member, and other components as appropriate.

Hereinafter, the structure of a drawer, which can be automatically drawn out and in, will be described. Simply for ease of discussion, movement of the upper door 17/receiving box 175 will be described. However, it is well understood that the concepts set forth herein may be applied to other doors/receiving boxes provided in both the refrigerating chamber 11 and the freezing chamber 12.

Hereinafter, the drawer will refer to an assembly of the door and the receiving box as described above, and the drawer driving assembly will refer to a structure that allows the drawer to be slidably movable with respect to the main body, including driving force generating and transmitting means that enable the drawer to move.

Figure 2:
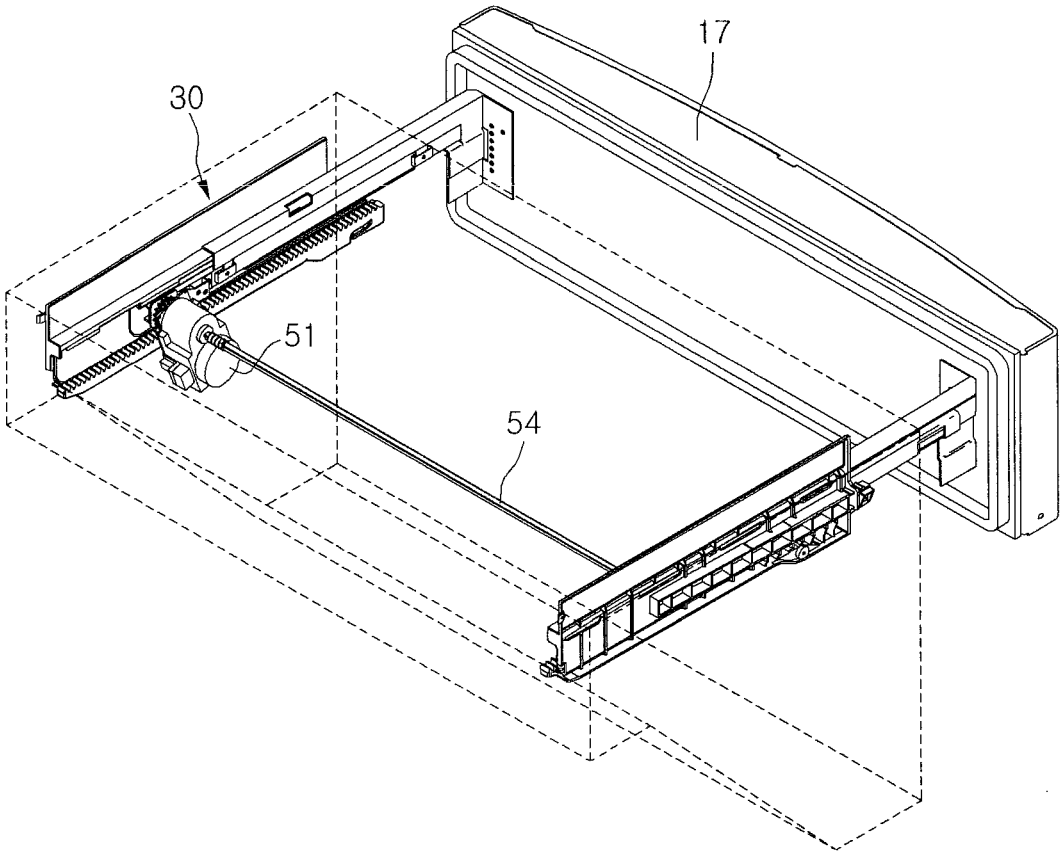
FIG. 2 is a rear perspective view of a door and a drawer driving assembly of the refrigerator shown FIG. 1.
Figure 3:
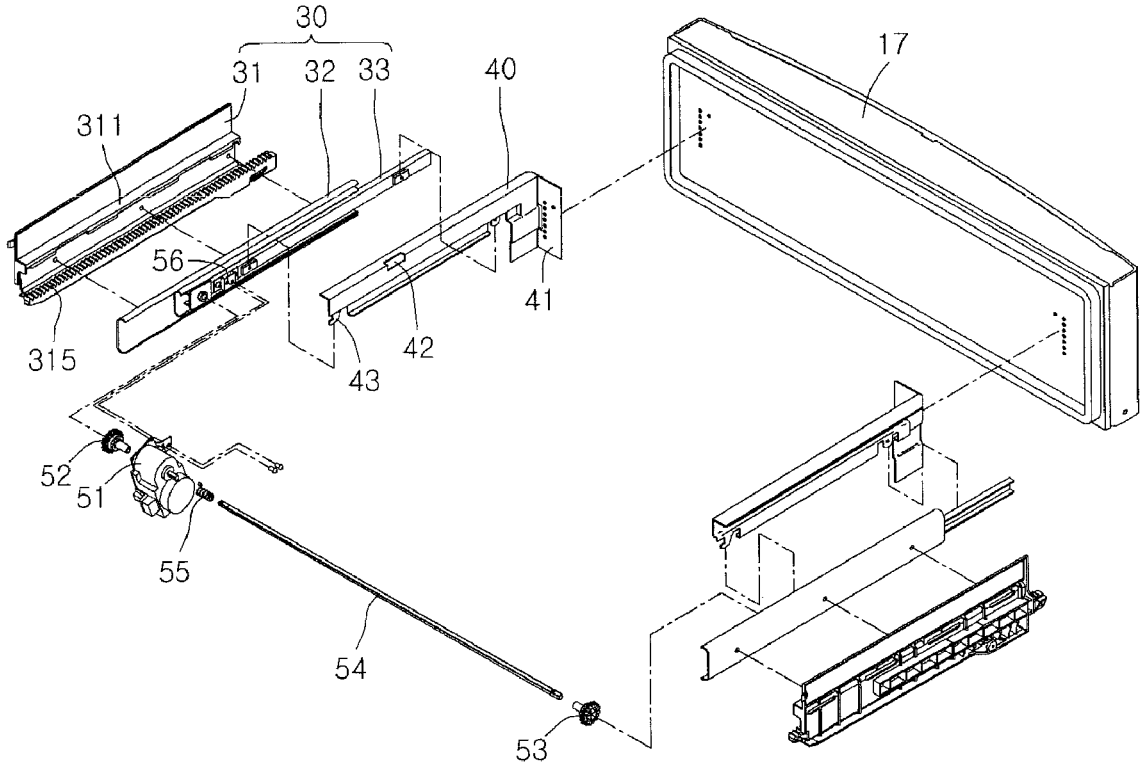
FIG. 3 is an exploded perspective view of the drawer driving assembly shown in FIG. 2.
Figure 4:
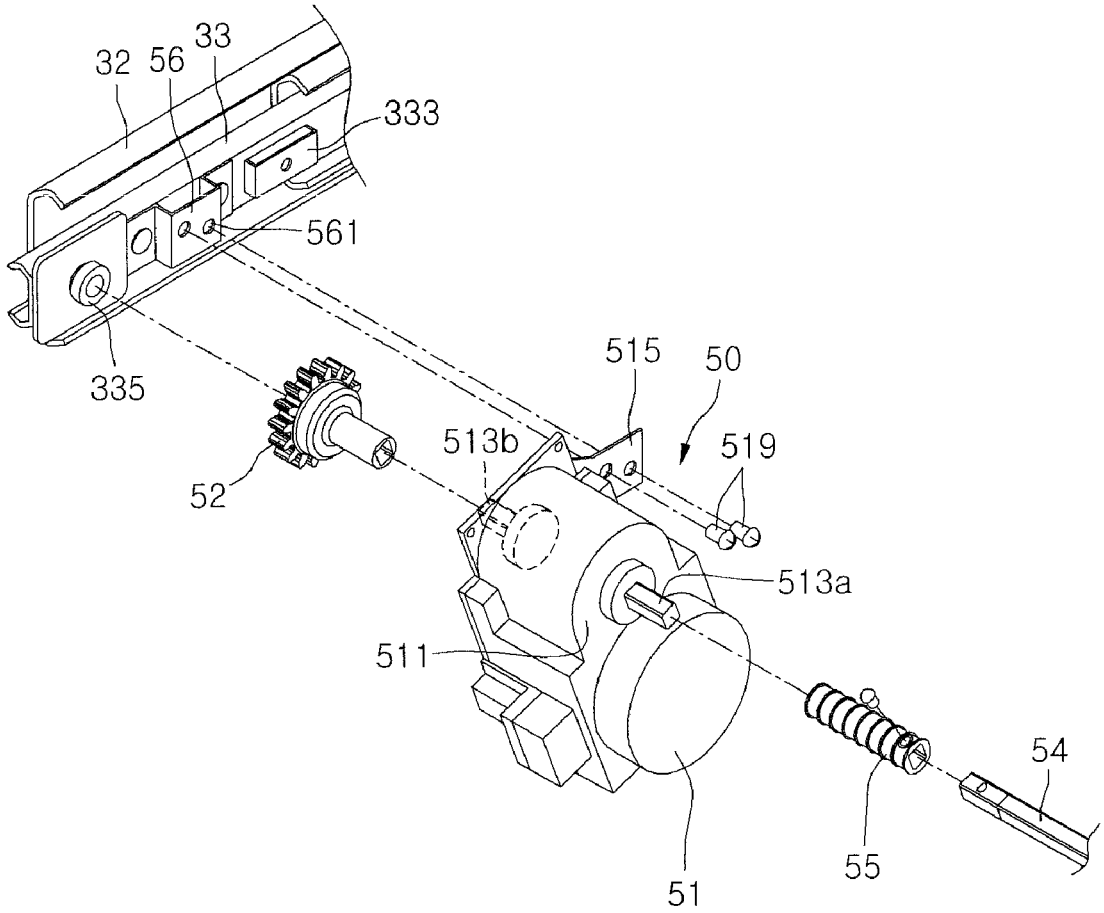
FIG. 4 is a detailed exploded perspective view of the drawer driving assembly shown in FIGS. 2 and 3.

Referring to FIGS. 2 to 4, a drawer driving assembly as embodied and broadly described herein may include a slide assembly 30 for guiding movement of the drawer in forward and backward directions and a driving assembly 50 for providing the slide assembly 30 with a driving force. The slide assembly 30 may be installed on an inner wall of main body, such as, for example, in the freezing chamber 12. A rail connector 40 may be coupled to and extend from a rear surface of the door 17, and may be detachably attached to the slide assembly 30. Accordingly, a portion of the slide assembly 30 moves in forward and backward directions, and as a result, the drawer coupled thereto may also move in forward and backward directions.

The receiving box 175 may be detachably coupled to the slide assembly 30 or to the rail connector 40. In this example, the receiving box 175 is detachably coupled to the rail connector 40.

The slide assembly 30 may include a rail guide 31 fixed to an inner wall of the freezing chamber 12, extending in a front to rear direction, a fixed rail 32 connected to the rail guide 31, and a movement rail 33 slidably connected to the fixed rail 32. The rail connector 40 is also connected to the movement rail 33. The rail guide 31 is not necessarily required for forming the slide assembly 30. For example, the fixed rail 32 may be directly fixed to the inner wall of the freezing chamber 12. A rack 315 may be provided at a lower portion of the rail guide 31 to engage and guide movement of a pinion 52. The movement rail 33 may include insert portion 333 in which a hanging ring 43 may be received, and may have a predetermined length in a longitudinal direction of the slide assembly 30 so as to receive the hanging ring 43. A bracket 56 may be provided at a rear end portion of the movement rail 33, at a position that is spaced apart from the insert portion 333 a predetermined distance in a backward direction. A plurality of bolting holes 561 may be provided in the bracket 56 for coupling a driving motor 51 to the bracket 56.

A pinion supporting portion 335 may be provided in the movement rail 33, spaced apart from the bracket 56 a predetermined distance so as to be coupled with the pinion 52, the driving motor 51 being connected to the bracket 56. In certain embodiments, the pinion supporting portion 335 may be integrally formed with the bracket 56. In this exemplary embodiment, the pinion supporting portion 335 is formed at the rear end portion of the bracket 56. A fixed groove may be formed in the pinion supporting portion 335 to receive the pinion 52 and allow the pinion 52 to rotate and engage the rack 315.

In alternative embodiments, the drawer may be drawn out in multiple stages by providing a plurality of movement rails 33.

A front end portion of the rail connector 40 may have a bent portion that extends in a direction that is parallel to the rear surface of the door 17 and is connected the rear surface the door 17. The hanging ring 43 may be formed at a lower end portion of the rail connector 40, at a location corresponding to the insert portion 333, and may be formed in a hook shape so as to be easily inserted into the insert portion 333. The opposite lower end portion of the rail connector 40 may be connected to the movement rail 33 by, for example, a bolt or other fastener as appropriate.

Accordingly, in a situation in which door 17 must be separated from the refrigerator 1 to, for example, allow the refrigerator 1 to pass through a small door or other opening into a room, the combination of the door 17 and the rail connector 40 may be separated from the refrigerator 1 by merely unfastening the bolt-connection of the rail connector 40 and the movement rail 33 and removing the hanging ring 43 from the insert portion 333.

A receiving box fixing groove 42 in which the receiving box 175 is detachably fixed may be formed in an upper surface of the rail connector 40. A protruding portion may be formed on the receiving box 175 for insertion into the fixing groove 42. Accordingly, when the receiving box 175 is safely attached to the rail connector 40, the protruding portion is inserted into the receiving box fixing groove 42.

The structure of the slide assembly 30 as described above may be applied to the two opposite interior walls of the refrigerator 1 so that the door 17 may be drawn out and in smoothly, and the bracket 56 may be provided at one of the two sides. That is, the driving motor 51 may be connected to one slide assembly at one of the two sides of the refrigerator 1.

The driving assembly 50 may include a housing 511 in which the driving motor 51 is received, and a pinion 52 rotatably connected to the driving motor 51 by a shaft 54. A flange 515 may extend outward from one side of the housing 511, and the flange 515 may be connected to the bracket 56 by a coupling member. The driving motor 51 may be integrated with the movement rail 33 by the connection of the flange 515 to the bracket 56. A first rotating shaft 513*a* and a second rotating shaft 513*b* may protrude from opposite sides of the housing 511, with the first rotating shaft 513*a* connected to a connection part 55 and the second rotating shaft 513*b* connected to the pinion 52.

The rotating shafts 513*a*, 513*b* may be oriented collinearly, and the driving motor 51 may rotate the rotating shafts 513*a*, 513*b* at the same time. In certain embodiments, the rotating shafts 513*a*, 513*b* may be formed as a single shaft. A reduction gear may be provided in an inner part of the housing 511, between corresponding ends of the rotating shafts 513*a*, 513*b*. When the flange 515 is fixed on the bracket 56, the center of the pinion 52 is rotatably connected to the pinion supporting portion 335. Accordingly, when the driving motor 51 is connected to the bracket 56, the center of the pinion supporting part 335, the center of the pinion 52, and the first and second rotating shafts 513*a*, 513*b* are aligned along the same axis of rotation.

When the pinion 52 is inserted into the pinion supporting part 335, the pinion 52 is sized so as to engage with the rack 315 so that the pinion 52 moves along the rack 315. The pinion 52 transmits a rotating force of the driving motor 51, and thus may be referred to as a member for transmitting a rotating force. The rack 315 guides operation of the member for transmitting the rotating force, and thus may be referred to as a guide member.

The first rotating shaft 513*a* may be connected to the shaft 54 by the connection part 55. A groove corresponding to a shape of the first rotating shaft 513*a* may be formed at one end of the connection part 55, and a groove corresponding to a shape of the shaft 54 may be formed at the other end. The first rotating shaft 513*a* may be inserted into one end of the connection part 55, and the shaft 54 may be inserted into the other end thereof, and thus, rotation of the first rotating shaft 513*a* may be transmitted to the shaft 54. The shaft 54 may be fixed to the connection part 55 by a bolt, or other fastener as appropriate.

The shaft 54 may extend across the freezing chamber 12, in a transverse direction, with one end thereof connected to the connection part 55, and the other thereof directly connected to a second pinion 53 that engages a second rack 315. Accordingly, when the rotating shafts 513*a*, 513*b* are rotated by the driving motor 51, both pinions 52, 53 are rotated at the same rotating velocity, and shaking in right and left directions caused during movement of the drawer may be prevented by such an assembly of the pinions 52, 53 and the shaft 54.

Operation of the refrigerator 1 according to an embodiment as broadly described herein will now be described.

When a command to draw the door 17 in or out is received at the input means 22, power is applied to the driving motor 51, and the rotating shafts 513*a*, 513*b* are rotated.

For example, when a drawing out (opening) command is received at input means 222, power is applied to the driving motor 51 and the rotating shafts 513*a*, 513*b* are rotated (in a clockwise direction as shown in FIG. 2). Accordingly, the pinions 52, 53 move in a forward direction along the rack 315 while rotating in a clockwise direction. The movement rail 33, which is connected to the driving motor 51, also moves in a forward direction, sliding according to the guidance of the guide part 323. The rail connector 40 is fixed to the movement rail 33, and thus, the receiving box 175 and the door 17 also move in a forward direction. The corresponding portion of the freezing chamber 12 is opened so as to provide access to the interior of the receiving box 175.

If a drawing-in (closing) command is received at input means 222, power is applied to the driving motor 51 so that the rotating shafts 513*a*, 513*b* rotate in a reverse direction (a counterclockwise direction as shown in FIG. 2), and the pinions 52, 53 move in a backward direction along the rack 315 while rotating in the counterclockwise direction. Accordingly, the movement rail 33 also moves in a backward direction and the door 17 closes.

As described above, in a refrigerator as embodied and broadly described herein, user convenience may be improved because the receiving box may be automatically drawn out or in along with the door by simply operating input means 222 to input drawing out and in commands.

Hereinafter, a method of controlling a refrigerator having a drawer driving structure as described above. In this method, power consumption, which is typically increased by maintaining a stand-by state because current is continuously supplied to the drawer driving means even when the door is closed, may be reduced. That is, in this method, when the door is closed, standby power is interrupted/cut off, and power is only supplied to the drawer driving means when a command for opening the door is received. Thus, when the door is closed, standby power is not consumed.

Figure 5:
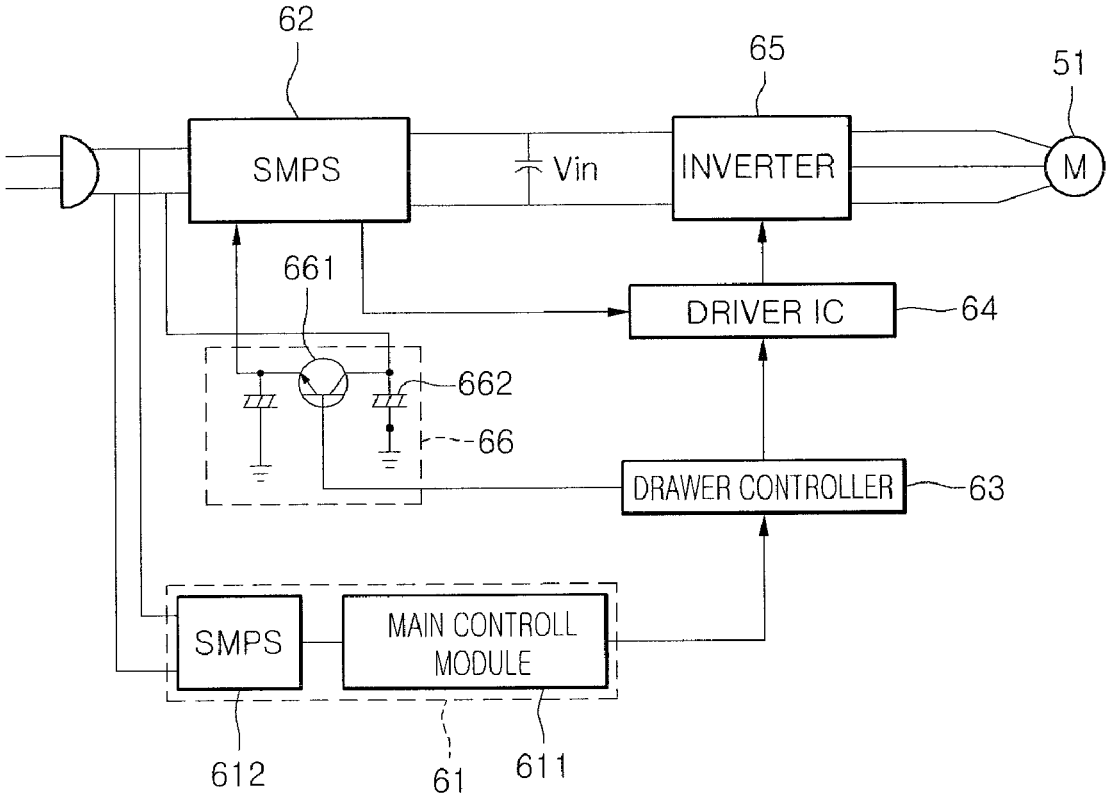
FIG. 5 is a block diagram of a control system of a refrigerator according to an embodiment as broadly described herein.

Referring to FIG. 5, a control system of a refrigerator as embodied and broadly described herein may include a main controller 61 that controls overall operation of the refrigerator including a main control module 611 and a main power supply 612 connected to the main control module 611 to supply power to electric components of the refrigerator 1. The control system may also include a drawer power supply 62 that supplies power to drawer driving means, a driver IC (Integrated Circuit) 64 that controls operation of the driving motor 51 based on motor driving signals from a drawer controller 63, an inverter 65 that applies three-phase current to the driving motor 51 based on a switching signal from the driver IC 64 and a switching module 66 that controls an on/off state of the drawer power supply 62 based on on/off signals from the drawer controller 63.

The main power supply 612 and the drawer power supply 62 may form a switching mode power supply (SMPS) to supply set voltage to electric components by converting commercial voltage supplied in a shape of alternating current to direct current. The driving motor 51 may be, for example, a three-phase BLDG motor capable of controlling velocity, or other type of motor as appropriate. Accordingly, the inverter 65 and the driver IC 64 for controlling such a three-phase BLCD motor may be provided.

The switching module 66 may allow the drawer power supply 62 to be turned on/off according to on/off signals from the drawer controller 63, and may be provided with a switch 661 in the shape of a transistor. A capacitor 662 may also be provided so that voltage may be charged and stored therein even when the drawer power supply 62 is in an off state.

As shown in FIG. 5, power may be supplied and stored in the capacitor 662 even when the switch 661 is in an off state. The voltage stored in the capacitor 662 may be used for operation of the drawer power supply 62 when it is actuated.

Thus, if a user inputs a command for opening the drawer when the drawer is closed, an ON-signal from the drawer power supply 62 is transmitted to the switching module 66 from the drawer controller 63.

The switch 661 switches to an ON state in response to the ON-signal and forms a closed circuit that supplies power to the drawer power supply 62. Initial power supplied to the drawer power supply 62 is the voltage stored in the capacitor 662. When power is supplied to the drawer power supply 62, the drawer power supply 62 starts to operate. That is, set current (or voltage) is supplied from the drawer power supply 62 to the inverter 65 according to a current (or voltage) application signal transmitted from the driver IC 64.

In contrast, when the user inputs a command for closing the drawer, the driving motor 51 is rotated in a reverse direction, and the drawer is closed. The reverse rotation of the driving motor 51 is performed under the control of the driver IC 64 and the inverter 65, and power continues to be supplied from the drawer power supply 62.

When the drawer is completely closed, the closing is sensed sensing means connected to the drawer and the main body of the refrigerator, and an off signal is sent from the drawer controller 63 to the drawer power supply 62. The switch 661 is switched to an off state in response to the off signal from the drawer power supply 62, thus disconnecting/interrupting the start-up circuit. As a result, power to the drawer power supply 62 is interrupted, and the drawer power supply 62 is shut off. At this point, standby voltage, which is supplied from the drawer power supply 62 to the inverter 65, is interrupted. Accordingly, the consumption of standby voltage may be reduced.

In this structure, power is always available to the main power supply 612, the main control module 611 and the drawer controller 63 from the capacitor 662. Further, an electric charge is held in the capacitor 662 from the point at which the drawer power supply 62 is shut off and the charge state is maintained until an on signal of the drawer power supply 62 is generated. When the on signal of the drawer power supply 62 is transmitted from the drawer controller 63, the voltage held in the capacitor 662 is directed toward the drawer power supply 62 as the switch 66 is moved to the on position.

In the system as described above, the consumption of standby voltage, which is always supplied to the drawer power supply 62 and the inverter 65, is eliminated, and the time it takes to convert the drawer power supply 62 from an off state to an on state is reduced because the voltage held in the capacitor 662 is supplied to the drawer power supply 62 at the point at which the switch 66 is moved to the on position.

Additional information regarding the structure and function of a drawer type refrigerator may be found in U.S. application Ser. Nos. 12/390,520, 12/390,523, 12/390,524, 12/390,527, 12/510,372, 12/724,558, 12/724,571 and 12/724,606, which are incorporated herein by reference.

A refrigerator is provided, including driving means allowing that a drawer provided at a lower side of the refrigerator is automatically drawn out, and having a mechanism allowing that the driving means is drawn in and out with a drawer.

A refrigerator is provided that is capable of reducing standby power consumption by preventing that power is applied to the drawer driving means when a drawer is closed, in a drawer mechanism capable of being automatically drawn in and out.

A refrigerator according to an embodiment as broadly described herein may include a main body in which a storage space is defined; a drawer, which is provided in the storage space and is movable in forward and backward directions; a driving motor for providing driving force to move the drawer; a drawer controller for controlling operation of the driving motor; a main controlling unit for controlling operation of electric components mounted in the main body; a main power supply unit for supplying power to the electric components mounted in the body; a drawer power supply unit for supplying necessary power to the driving motor; and a switching part for blocking the supply of power to keep the drawer power supply unit in an off state by receiving operating signals transmitted from the drawer controller when the drawer is closed.

In a refrigerator as embodied and broadly described herein, the drawer is automatically drawn out or in by inputting drawing in and out orders without that the user directly pulls the drawer.

Furthermore, when the drawer is closed, the supply of standby power is intercepted by various kinds of controlling means for controlling the drawer driving means, and thus, there is an advantage in that power consumption is reduced.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a main body having a storage space formed therein;

a drawer movably positioned in the storage space;

a driving motor that generates a driving force to move the drawer;

a drawer controller that controls operation of the driving motor;

a main controller that controls operation of electrical components of the refrigerator;

a main power supply that supplies power to the electrical components of the refrigerator;

a drawer power supply that supplies power to the driving motor; and a switching module that blocks the supply of power to the drawer power supply to maintain the drawer power supply and the driving motor in an off state in response to operating signals transmitted from the drawer controller when the drawer is closed.

2. The refrigerator according to claim 1, wherein the switching module comprises:

a switch that selectively connects and disconnects a start-up circuit of the drawer power supply based on a corresponding signal transmitted from the drawer controller; and a capacitor that stores voltage when the drawer power supply is in an off state, wherein the drawer power supply applies the voltage stored in the capacitor to the driving motor in response to the signal transmitted from the drawer controller.

3. The refrigerator according to claim 2, wherein the switch is a transistor.

4. The refrigerator according to claim 2, wherein power is supplied to the capacitor irrespective of an on/off state of the drawer power supply.

5. The refrigerator according to claim 2, wherein the main controller and the drawer controller are configured to receive power from the main power supply.

6. The refrigerator according to claim 2, wherein the switch is in an off position when the drawer is closed such that standby voltage supplied from the drawer power supply to electrical components that drive the driving motor is blocked.

7. The refrigerator according to claim 6, wherein the driving motor is a three-phase BLDC motor, and the electrical components that drive the driving motor include an inverter that controls driving of the driving motor and a driver integrated circuit (IC).

8. The refrigerator according to claim 2, wherein when the switch is in an on position, voltage stored in the capacitor is supplied to the drawer power supply, and the drawer power supply is turned on.

9. The refrigerator according to claim 1, wherein when a drawer opening command is received, an On signal of the drawer power supply is transmitted from the drawer controller to the switching module, and, at a point at which the door is closed, an Off signal of the drawer power supply is transmitted from the drawer controller to the switching module.

* * * * *